US011443911B2

(12) United States Patent
Oh et al.

(10) Patent No.: US 11,443,911 B2
(45) Date of Patent: Sep. 13, 2022

(54) ARC CHAMBER OF CIRCUIT BREAKER

(71) Applicant: LS ELECTRIC CO., LTD., Anyang-si (KR)

(72) Inventors: Kyunghwan Oh, Anyang-si (KR); Kihwan Oh, Anyang-si (KR)

(73) Assignee: LS ELECTRIC CO., LTD., Anyang-si (KR)

( * ) Notice: Subject to any disclaimer, the term of this patent is extended or adjusted under 35 U.S.C. 154(b) by 271 days.

(21) Appl. No.: 16/772,556

(22) PCT Filed: Nov. 22, 2018

(86) PCT No.: PCT/KR2018/014437
§ 371 (c)(1),
(2) Date: Jun. 12, 2020

(87) PCT Pub. No.: WO2019/132259
PCT Pub. Date: Jul. 4, 2019

(65) Prior Publication Data

US 2020/0395183 A1 Dec. 17, 2020

(30) Foreign Application Priority Data

Dec. 27, 2017 (KR) ..... 20-2017-0006745

(51) Int. Cl.
*H01H 73/18* (2006.01)
*H01H 73/06* (2006.01)
(Continued)

(52) U.S. Cl.
CPC ..... *H01H 73/18* (2013.01); *H01H 9/36* (2013.01); *H01H 73/04* (2013.01); *H01H 73/06* (2013.01)

(58) Field of Classification Search
CPC ..... H01H 9/346; H01H 9/345; H01H 9/36; H01H 9/362; H01H 2009/365;
(Continued)

(56) References Cited

U.S. PATENT DOCUMENTS 6,248,970 B1 * 6/2001 DiMarco ..... H01H 9/34 218/15
8,089,023 B2 * 1/2012 Kanno ..... C08L 23/02 218/150
(Continued)

FOREIGN PATENT DOCUMENTS

CN 203250707 U 10/2013
JP H08227648 A 9/1996
(Continued)

OTHER PUBLICATIONS

Translation of KR2013-0064449(Original document published Jun. 18, 2013) (Year: 2013).*
(Continued)

*Primary Examiner* — William A Bolton
(74) *Attorney, Agent, or Firm* — K&L Gates LLP

(57) ABSTRACT

The present device was conceived in order to resolve the aforementioned problem, and the objective thereof is to provide an arc chamber of a circuit breaker that enhances assemblability and ensures the consistency of the product. An arc chamber of the circuit breaker according to one embodiment of the present device comprises: a plurality of grids arranged at predetermined intervals outside a motion locus of a movable contactor and having a body portion and a leg portion extending from one side of the body portion; and a fixing cap having a receiving portion that is inserted into the leg portion in a press-fitting manner, wherein the fixing cap has a coupling portion extending to a side of the body portion at one side thereof.

8 Claims, 8 Drawing Sheets

(51) Int. Cl.
*H01H 73/04* (2006.01)
*H01H 9/36* (2006.01)

(58) Field of Classification Search
CPC ..... H01H 73/18; H01H 73/04; H01H 73/06; H01H 71/1009; H01H 71/12; H01H 71/123; H01H 2071/0292
USPC ..... 335/2; 218/15, 34, 38, 46, 149, 153
See application file for complete search history.

(56) References Cited

U.S. PATENT DOCUMENTS

| | | | | |
|---|---|---|---|---|
| 9,324,519 | B2 * | 4/2016 | Karlen | H01H 9/362 |
| 9,673,004 | B1 * | 6/2017 | Ruempler | H01H 9/36 |
| 2005/0263492 | A1 | 12/2005 | McCoy | |
| 2006/0086693 | A1 | 4/2006 | Yeon | |
| 2008/0067150 | A1 | 3/2008 | Shea et al. | |
| 2010/0258531 | A1 | 10/2010 | Bresciani et al. | |
| 2012/0006791 | A1 | 1/2012 | Ham | |
| 2015/0348720 | A1 * | 12/2015 | Smeltzer | H01H 9/34 218/151 |

FOREIGN PATENT DOCUMENTS

| | | | |
|---|---|---|---|
| JP | 2006120643 | A | 5/2006 |
| JP | 2014225452 | A | 12/2014 |
| KR | 101094775 | B1 | 12/2011 |
| KR | 2020130000096 | | 1/2013 |
| KR | 20130064449 | A | 6/2013 |
| KR | 101412593 | B1 | 6/2014 |
| KR | 200477246 | Y1 | 5/2015 |
| KR | 20150089729 | A | 8/2015 |
| KR | 20150092628 | A | 8/2015 |
| KR | 20160019757 | A | 2/2016 |
| WO | 2013178257 | A1 | 12/2013 |

OTHER PUBLICATIONS

Japanese Office Action for related Japanese Application No. 2020-535054; dated Jun. 18, 2021; (3 pages).
Extended European Search Report for related European Application No. 18897478.6; dated Aug. 10, 2021; (8 pages).
Korean Office Action for related Korean Application No. 20-2017-0006745; dated Jul. 22, 2020; (4 pages).
International Search Report for related International Application No. PCT/KR2018/014437; dated Jul. 4, 2019; (5 pages).
Written Opinion for related International Application No. PCT/KR2018/014437; dated Jul. 4, 2019; (6 pages).

* cited by examiner

ARC CHAMBER OF CIRCUIT BREAKER

CROSS-REFERENCE TO RELATED APPLICATIONS

This application is the National Stage filing under 35 U.S.C. 371 of International Application No. PCT/KR2018/014437, filed on Nov. 22, 2018, which claims the benefit of earlier filing date and right of priority to Korean Application No. 20-2017-0006745, filed on Dec. 27, 2017, the contents of which are all hereby incorporated by reference herein in their entirety.

FIELD OF THE INVENTION

The present disclosure relates to an arc chamber of a circuit breaker, and more particularly, an arc chamber of a circuit breaker capable of facilitating easier assembly and ensuring secure coupling.

BACKGROUND OF THE INVENTION

Generally, a molded case circuit breaker (MCCB) is an electric device that protects circuits and loads by automatically shutting off circuits in the event of an electrical overload or short circuit. The MCCB mainly includes a terminal that provides connection between a power supply (or source) side and a load side, an opening and closing mechanism that allows a fixed terminal and a movable terminal to make a mechanical contact, and a trip unit that detects an overcurrent or short-circuit current at the power supply side to induce (or cause) a tripping action of the opening and closing mechanism, and an arc extinguishing system (chamber) that extinguishes an arc generated when an abnormal current is shut off.

FIG. 1 illustrates a longitudinal sectional view of a MCCB according to the related art. The circuit breaker according to the related art includes a fixed contact 2*a* and a movable contact 2*b* constituting a contact unit provided to connect or shut off a circuit transmitted from a power supply side to a load side inside a case 1 made of an insulating material, an opening and closing mechanism 3 providing power that allows the movable contact 2*b* to be rotated, a detecting mechanism 4 for detecting an abnormal current, and an arc extinguishing system (arc chamber) 5 configured to extinguish an arc generated when an incident current is shut off.

FIGS. 2 and 3 are perspective and exploded perspective views, respectively, illustrating a detailed view of an arc chamber.

A cold cathode type arc chamber using a metal plate is mainly used for an arc extinguishing system of the circuit breaker, in which grids 6 made of a steel plate having a V-shaped groove are arranged in a direction perpendicular to an arc generating path at an appropriate interval. When an incident current occurs, the contacts 2*a* and 2*b* are opened, causing an arc. Then, the arc flows (or moves) to the grid 6 from the arc chamber 5. The arc is cooled by the grids 6 and divided into short arcs between each of the grids 6, thereby increasing the arc voltage and decreasing the current. In addition, internal pressure of the casing is increased by an extinguishing gas generated from an insulating plate (not shown) constituting the arc extinguishing system so as to compress the arc at a high pressure and to suppress emission of free electrons, thereby rapidly extinguishing the arc and restoring an inter-pole voltage.

When an abnormal current is generated, the tripping action is initiated and an arc generated accordingly is extinguished and emitted to shut off an incident current, which is very important for the MCCB to protect the product, loads, and power lines, and is directly related to performance of the circuit breaker. The arc chamber of the arc extinguishing system greatly affects the performance. That is, an assembly state of the arc chamber, maintaining its assembled shape and position, and the like significantly affect the performance of the circuit breaker.

In a configuration according to the related art, the arc chamber 5 includes a plurality of grids 6 arranged at regular intervals in an outer direction of a rotation trajectory of the movable contact 2*b*, a pair of fixing plates 7, a cap 8 coupled to a leg portion of the grid 6.

In the related art, holes 7*a* of the fixing plate 7 are fitted into protrusions 6*a* formed on a side surface of the grid 6, and caulking is used for coupling the fixing plate 7 to the grid.

For the caulking, the protrusions 6*a* on both sides of the grid 6 are pressed with a strong force to be deformed. Such an operation (or process) is difficult to perform in a consistent manner, and efficiency may be decreased accordingly. Also, it can be difficult to ensure the same quality. In addition, the grid 6 may be deformed, cracked, twisted, or the like. When the caulking is not done properly, or omitted (skipped), the grid 6 may be displaced (or separated) during transportation or assembling the finished product. Multiple caulking operations cause problems such as an increase in a processing time, a decrease in productivity, an inconsistent or improper distance (or gap) between the grids 6, and an increase in production costs. In addition to that, maintenance is not available.

BRIEF SUMMARY OF THE INVENTION

The present disclosure is directed to solving the above-mentioned problems. An aspect of the present disclosure is to provide an arc chamber of a circuit breaker capable of improving assemblability and ensuring product consistency.

Embodiments disclosed herein provide an arc chamber of a circuit breaker that may include a plurality of grids arranged outside of a motion trajectory of a movable contact at a predetermined interval and including a body portion and a leg portion extending from one side of the body portion, and a fixing cap having an accommodating portion press-fitted into the leg portion. The fixing cap may be provided with a coupling portion extending to a side surface of the body portion from one side thereof.

Here, a plurality of first protrusions may be provided at both corners of the body portion, and a plurality of fixing grooves coupled to the first protrusions may be provided on an end of the coupling portion.

A plurality of second protrusions disposed adjacent to the leg portion may be provided at both side surfaces of the body portion, and a plurality of fixing holes fitted to the second protrusions may be provided on the coupling portion.

Each of the second protrusions may be inclined downwardly toward the leg portion.

Each of the second protrusions may be provided with an interference prevention groove provided at both ends thereof in contact with the body portion.

The coupling portion may be provided with partition walls formed on an inner surface thereof corresponding to a position between each of the first protrusions, so that each of the grids is fitted.

An extended wall extending from the partition wall may be provided on an inner wall of the fixing cap.

A thickness of the extended wall may be less than a thickness of the partition wall.

A rib that presses the leg portion may be provided between the partition walls.

A hemispherical protrusion in contact with the extended wall may be provided on an upper surface of the leg portion.

In an arc chamber of a circuit breaker according to one embodiment of the present disclosure, assembly is simple and easy to implement by coupling a fixing cap to a grid in a press-fitting manner. Thus, a time taken for multiple caulking operations is reduced.

In addition, an accommodating portion of the fixing cap is fitted to a leg portion of the grid, and a coupling portion of the fixing cap is fitted to a side surface of a body portion of the grid, ensuring a secure coupling force. Also, a coupling force generated due to friction between each of the grids by a partition wall of the fixing cap is provided. Thus, no deformation or displacement of the grid occurs.

Further, a gap or spacing between the grids remains constant.

Furthermore, as the grid can be detached from the fixing cap, maintenance and repairs are available.

DETAILED DESCRIPTION OF THE INVENTION

Hereinafter, preferred embodiments of the present disclosure will be described with reference to the accompanying drawings, so that a person skilled in the art can easily carry out the disclosure. It should be understood that the technical idea and scope of the present disclosure are not limited to those preferred embodiments.

Figure 4:
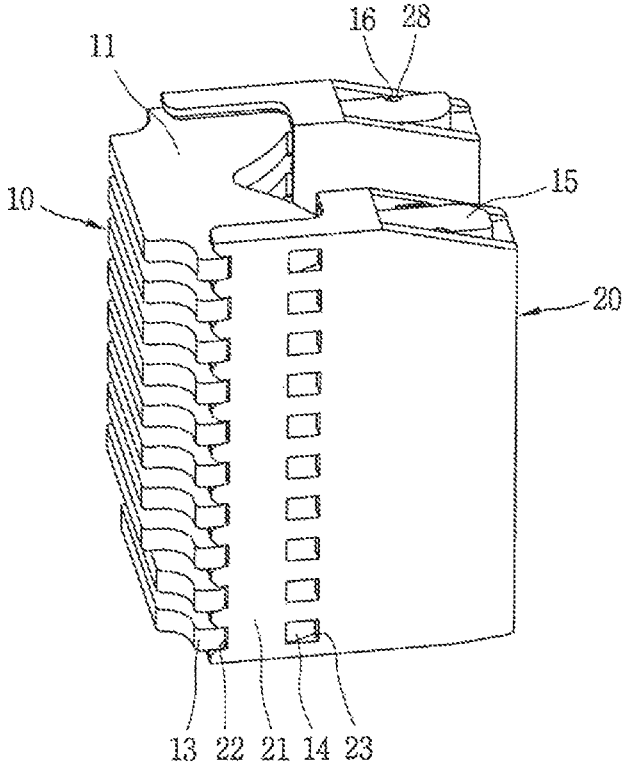
FIG. 4 is a perspective view of an arc chamber of a circuit breaker according to one embodiment of the present disclosure.
Figure 5:
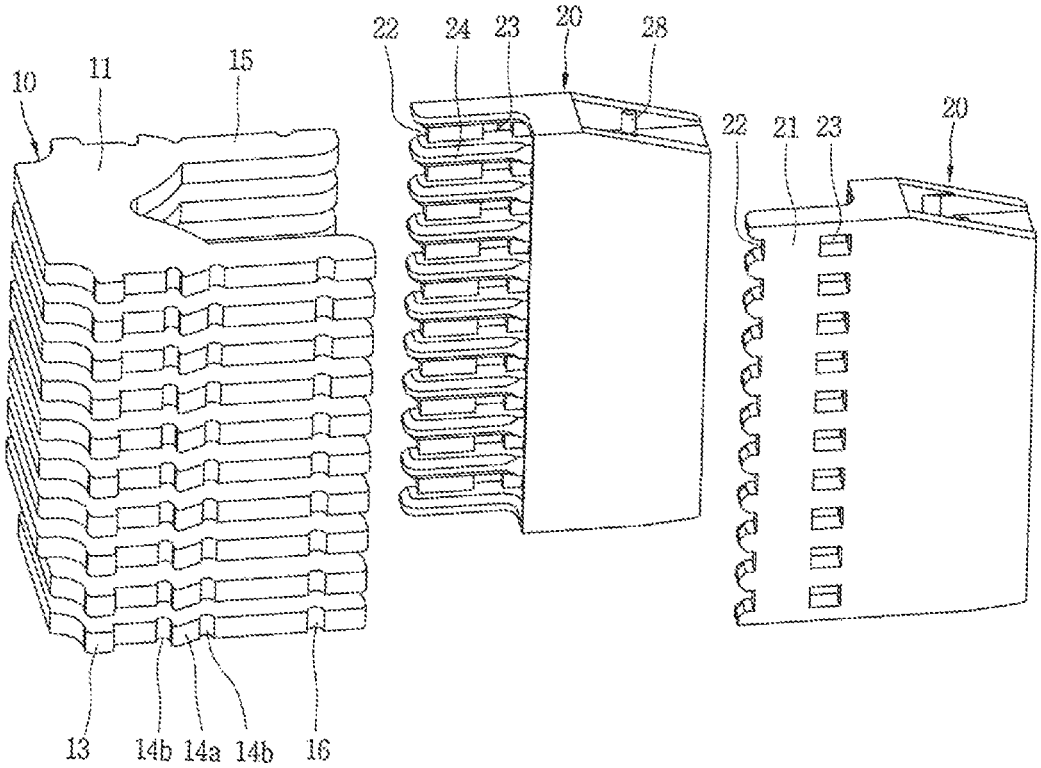
FIG. 5 is an exploded perspective view of an arc chamber of a circuit breaker according to one embodiment of the present disclosure.
Figure 6:
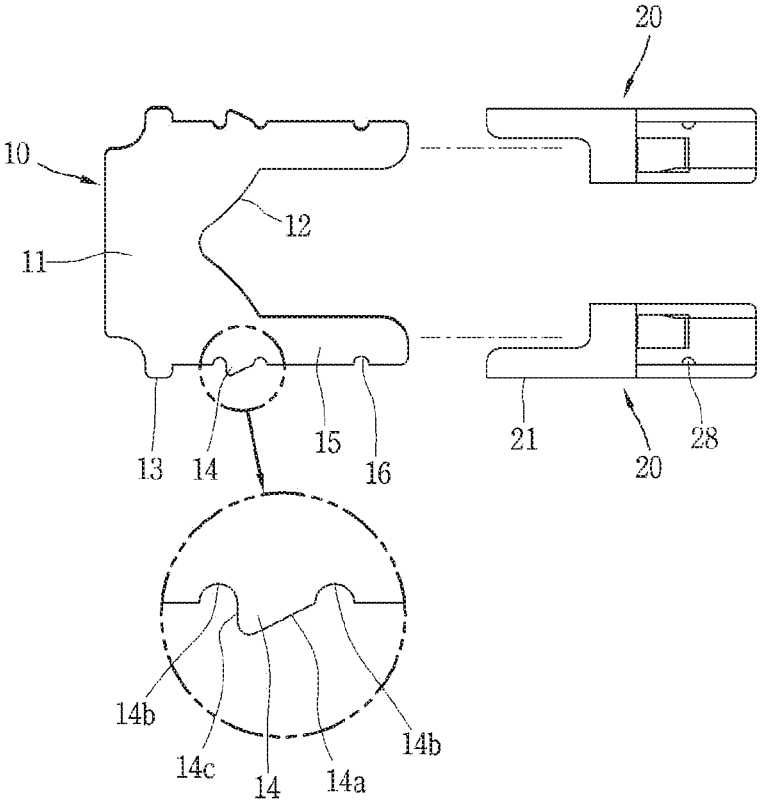
FIG. 6 is a top view of an arc chamber of a circuit breaker according to one embodiment of the present disclosure.
Figure 7:
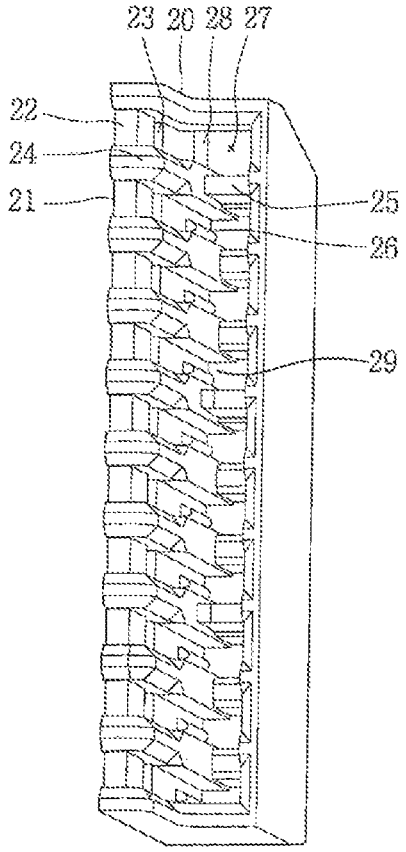
FIG. 7 is a perspective view of a fixing cap applied to a circuit breaker according to one embodiment of the present disclosure.

Referring to FIGS. 4 to 6, an arc chamber of a circuit breaker according to one embodiment of the present disclosure is illustrated. FIG. 4 is a perspective view of the arc chamber, FIG. 5 is an exploded perspective view of the arc chamber, and FIG. 6 is a top view of the arc chamber. FIG. 7 is a perspective view of a fixing cap. The arc chamber of the circuit breaker according to one embodiment of the present disclosure will be described in detail with reference to the drawings.

In the arc chamber of the circuit breaker according to one embodiment, the arc chamber is installed at an upper portion of a fixed contact and disposed to cover a movable contact (or contactor) in contact with or separated from the fixed contact. The arc chamber includes a plurality of grids 10 arranged outside a motion trajectory (or motion locus) of the movable contact and including a body portion 11 and a leg portion 15, and a fixing cap 20 press-fitted into the leg portion 15. Also, a coupling portion 21 extending from one side of the fixing cap 20 to a side surface of the body portion 11 is provided.

Figure 1:
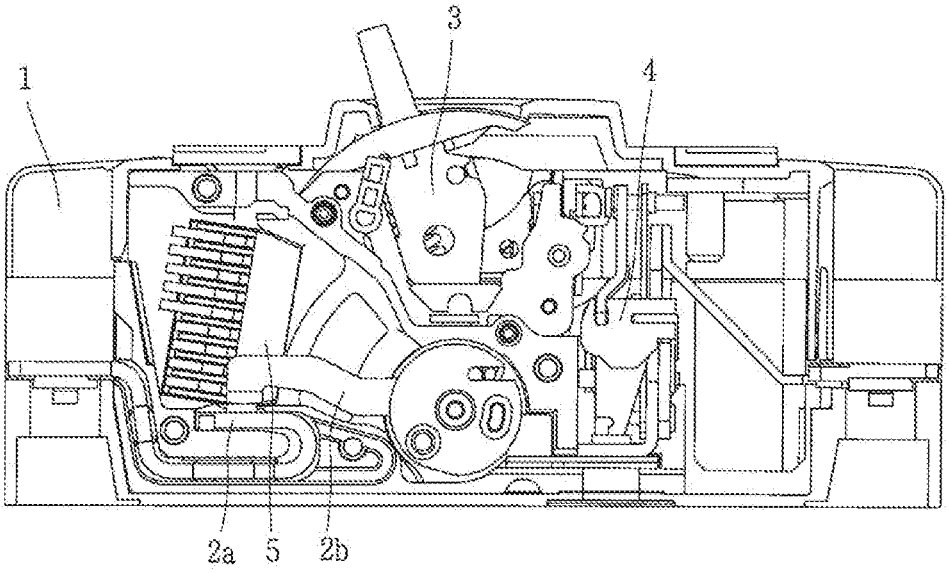
FIG. 1 Prior Art
FIG. 1 is a longitudinal sectional view of a circuit breaker according to the related art.
Figure 2:
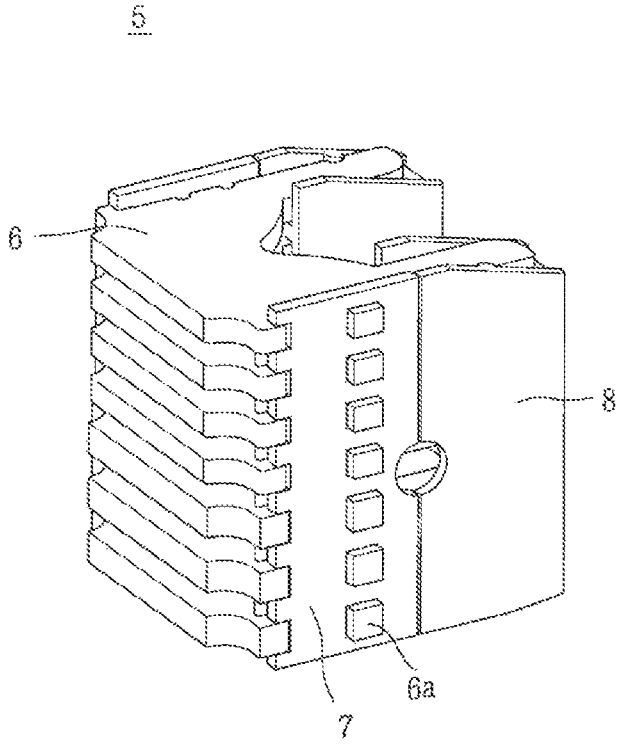
FIG. 2 Prior Art
FIGS. 2 and 3 are perspective and exploded perspective views, respectively, illustrating an arc chamber employed in the related art circuit breaker.
Figure 3:
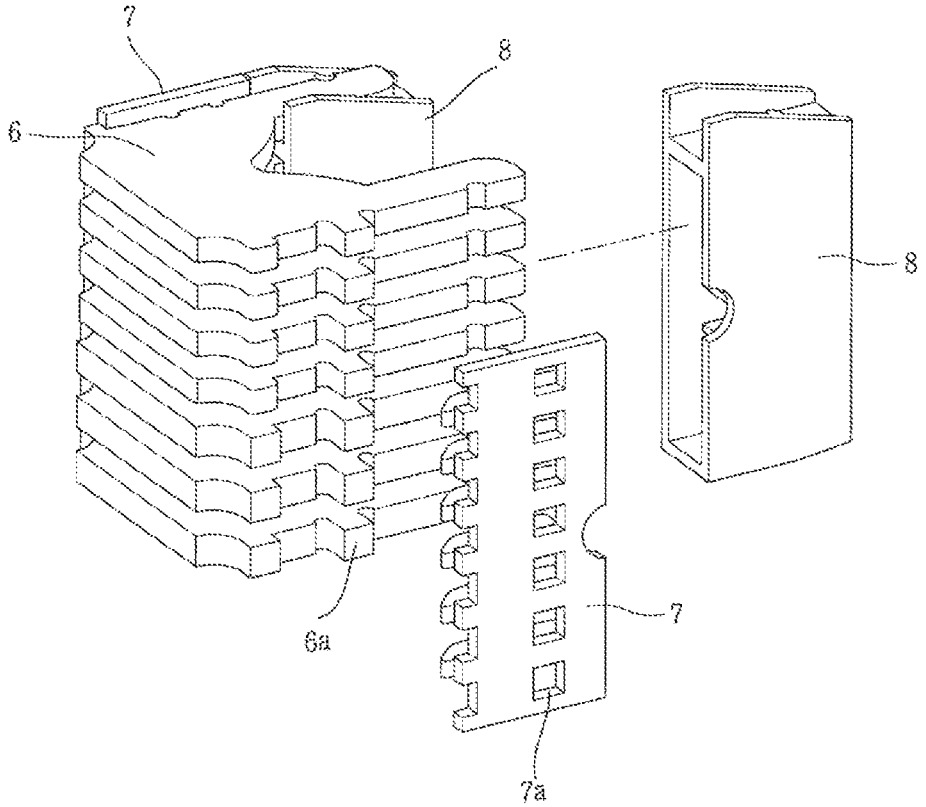
FIG. 3 Prior Art

In describing the arc chamber of the circuit breaker according to embodiments disclosed herein, technical details such as a fixed contact connected to a casing, a load, or power supply, and a movable contact rotatably installed inside the casing so as to be in contact with or separated from the fixed contact are the same as the related art, so a description thereof or drawings will be omitted. (Please refer to the background section and FIG. 1)

When the fixed contact and the movable contact are separated from each other (i.e., the contacts are opened), a flow of current in a main circuit is interrupted. On the other hand, when the fixed contact and the movable contact are in contact with each other (i.e., the contacts are closed), the flow of current in the main circuit is allowed. When the flow of current is shut off, a movable point of contact of the movable contact is separated from a fixed point of contact of the fixed contact, and an arc is generated by the inertia of current (properties that maintain the flow of current). That is, an arc is generated between the contacts. This is a phenomenon of electrical breakdown or dielectric breakdown caused by an insulator at atmospheric pressure. The voltage at which the insulator becomes electrically conductive in a plasma state, which increases in proportion to the intensity of current. At this time, the central temperature of the arc reaches 8,000 to 12,000° C., having explosive expansion pressure enough to melt and wear down the contacts and enough to deteriorate and destroy the insulator.

The grid 10 is implemented as a flat plate made of a metal (or metallic) material having ferromagnetic properties. The grid 10 is provided in plurality so to be spaced apart from one another by a predetermined interval. That is, the plurality of grids 10 forms a layer to generate a plurality of spaces so as to allow arc to be divided between the grids 10. The grid 10 includes the body portion 11 and the leg portion 15 extending from the body portion 11.

The body portion 11 may be formed in a rectangular shape. An arc guide portion 12 formed as a V'-shaped groove is provided at a central part of one side of the body portion 11. The leg portion 15 is respectively provided on both sides of the arc guide portion 12.

A first protrusion 13 and a second protrusion 14 are provided on both sides of the body portion 11. The first protrusion 13 and the second protrusion 14 are provided for coupling the fixing cap 20. The first protrusion 13 and the second protrusion 14 may be spaced apart from each other. The first protrusion 13 is provided at a corner of the body portion 11. The second protrusion 14 is disposed to be adjacent to the leg portion 15. The first protrusion 13 is located further away than the second protrusion 14 with respect to the leg portion 15.

The first protrusion 13 may be formed as a square protrusion.

The second protrusion 14 may be formed as a triangular protrusion. That is, the second protrusion 14 is provided with an inclined portion 14*a*. The inclined portion 14*a* is inclined downwardly toward the leg portion 15. The inclined portion 14*a* provided on the second protrusion 14 allows the fixing cap 20 to be easily fitted into the grid 10, thereby making assembly easier. In addition, as a rear (or rearward) portion 14*c* of the second protrusion 14 is perpendicular to the side surface of the body portion 11 or a side surface of the leg portion 15, the fixing cap 20 is not separated from the grid 10 after being coupled thereto.

An interference prevention groove 14*b* is provided on both ends that are in contact with the body portion 11 of the second protrusion 14. An interference surface (a connection surface that may be generated after a punching process) generated on a contact surface between the body portion 11 and the second protrusion 14 may be removed by the interference prevention groove 14*b*. This allows the fixing the cap 10 to be tightly coupled to the grid 10 without any gap.

The leg portion 15 is provided at one side of the body portion 11 (the side on which the arc guide portion is provided). The leg portion 15 is provided on both sides of the arc guide portion 12 in an extending manner. The leg portion 15 is formed as a pair of symmetrical legs. The leg portion 15 is provided with a coupling groove 16.

The fixing cap 20 has a box shape with one side surface open. That is, the fixing cap 20 has an accommodating portion 29 in which an accommodation space is formed. The leg portion 15 of the grid 10 is inserted into the opened part of the fixing cap 20 so as to be insertedly coupled to the accommodating portion 29. The fixing cap 20 is provided in a symmetrical pair to be fitted into the pair of leg portions 15.

The coupling portion 21 extends to one side of the fixing cap 20. The coupling portion 21 is disposed at an outer side of the body portion 11. The coupling portion 21 is provided with a fixing groove 22 into which the first protrusion 13 is fitted, and a fixing hole 23 into which the second protrusion 14 is fitted. The fixing groove 22 is provided at an end of the coupling portion 21 so as to allow the first protrusion 13 to be partially engaged therewith. The fixing hole 23 is fixed by fitting the fixing cap 20 to the grid 10.

The fixing groove 22 and fixing hole 23 are provided in plurality, respectively. The number of the fixing grooves 22 and fixing holes 23 may be equal to the number of grids 10. The grids 10 may be arranged according to a gap or spacing between each of the fixing grooves 22 and the fixing holes 23. Each of the fixing grooves 22 and fixing holes 23 may be provided at the same height.

The leg portion 15 is fitted to the accommodating portion 29 of the fixing cap 20, and the accommodating portion 21 is brought into contact with the side surface of the body portion 11 to be coupled to the first protrusion 13 and the second protrusion 14, thereby ensuring secure coupling. As the accommodating portion 29 covers (or surrounds) the leg portion 15, and at the same time the coupling portion 21 is fitted into the protrusions 13 and 14 provided at the side surface of the body portion 11, the fixing cap 20 is securely coupled to the grid 10, thereby preventing the grid 10 from being displaced (or detached).

A plurality of partition walls 24 are provided on an inner surface of the coupling portion 21 so as to allow each of the grids 10 to be fitted therebetween. As the grid 10 is coupled between adjacent partition walls 24, a coupling force is increased by friction. The partition wall 24 is formed from an end of the coupling portion 21 to an inner wall of the accommodating portion 29.

An extended wall 25 extending from the partition wall 24 is provided on an inner wall of the fixing cap 20. A thickness of the extended wall 25 may be less than a thickness of the partition wall 24. This allows the leg portion 15 to be easily inserted into the innermost part of the accommodating portion 29. In addition, it facilitates easier insertion and coupling of the leg portion 15 as an excessive frictional force is not generated.

A rib 26 is provided between the partition walls 24. The rib 26 presses the leg portion 15 to increase a coupling force by friction.

An opening hole 27 is provided at an upper portion of the fixing cap 20 so that the grid 10 disposed at the uppermost end is exposed.

A coupling protrusion 28 is provided at the upper portion of the fixing cap 20, so as to be fitted into the coupling groove 16 of the grid 10.

Figure 8:
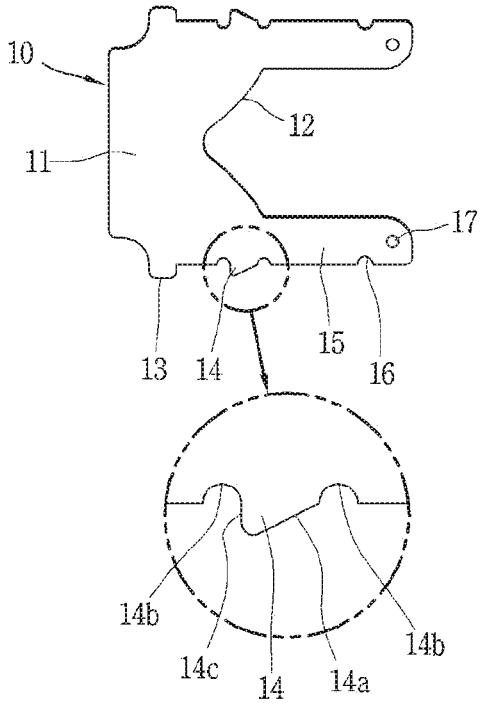
FIG. 8 is a planar view of a grid applied to an arc chamber of a circuit breaker according to another embodiment of the present disclosure.

FIG. 8 illustrates a grid according to another embodiment of the present disclosure.

In the grid according to this embodiment, a hemispherical protrusion 17 is provided on an upper surface of the leg portion 15. Accordingly, when the grid 10 is inserted into the fixing cap 20, the hemispherical protrusion 17 of the leg portion 15 is brought into the extended wall 25 to increase a coupling force due to friction.

In an arc chamber of a circuit breaker according to one embodiment of the present disclosure, assembly is simple and easy to implement by coupling a fixing cap to a grid in a press-fitting manner. Thus, a time taken for multiple caulking operations is reduced.

In addition, an accommodating portion of the fixing cap is fitted to a leg portion of the grid, and a coupling portion of the fixing cap is fitted to a side surface of a body portion of the grid, ensuring a secure coupling force. Also, a coupling force generated due to friction between each of the grids by a partition wall of the fixing cap is provided. Thus, no deformation or displacement of the grid occurs.

Further, a gap or spacing between the grids remains constant.

Furthermore, as the grid can be detached from the fixing cap, maintenance and repairs are available.

The embodiments disclosed in the present disclosure are not intended to limit the scope of the present disclosure but are merely illustrative, and it should be understood that the scope of the technical idea of the present disclosure is not limited by those embodiments. That is, the scope of protection of the present disclosure should be construed according to the appended claims, and all technical ideas within the scope of equivalents thereof should be construed as being included in the scope of the present disclosure.

The invention claimed is:

1. An arc chamber of a circuit breaker, comprising:

a plurality of grids arranged outside of a motion trajectory of a movable contact at a predetermined interval and including a body portion and a leg portion extending from one side of the body portion; and a fixing cap having an accommodating portion press-fitted into the leg portion, wherein the fixing cap is provided with a coupling portion extending to a side surface of the body portion from one side thereof, wherein a plurality of second protrusions disposed adjacent to the leg portion is provided at both side surfaces of the body portion, wherein a plurality of fixing holes fitted to the second protrusions is provided on the coupling portion, and wherein each of the second protrusions is provided with an interference prevention groove provided at both ends thereof in contact with the body portion.

2. The arc chamber of claim 1, wherein a plurality of first protrusions is provided at both corners of the body portion, and wherein a plurality of fixing grooves coupled to the first protrusions is provided on an end of the coupling portion.

3. The arc chamber of claim 1, wherein each of the second protrusions is inclined downwardly toward the leg portion.

4. The arc chamber of claim 1, wherein the coupling portion is provided with partition walls formed on an inner surface thereof corresponding to a position between each of the first protrusions, so that each of the grids is fitted.

5. The arc chamber of claim 4, wherein an extended wall extending from the partition wall is provided on an inner wall of the fixing cap.

6. The arc chamber of claim 5, wherein a thickness of the extended wall is less than a thickness of the partition wall.

7. The arc chamber of claim 5, wherein a hemispherical protrusion in contact with the extended wall is provided on an upper surface of the leg portion.

8. The arc chamber of claim 4, wherein a rib that presses the leg portion is provided between the partition walls.

* * * * *